US011077356B2

(12) United States Patent
Beylin et al.

(10) Patent No.: US 11,077,356 B2
(45) Date of Patent: Aug. 3, 2021

(54) ROLLER SKATES

(71) Applicants: Georgiy Volodymyrovych Beylin, Kiev (UA); Sergiy Yuriiovich Petrenko, Kiev (UA)

(72) Inventors: Georgiy Volodymyrovych Beylin, Kiev (UA); Sergiy Yuriiovich Petrenko, Kiev (UA)

( * ) Notice: Subject to any disclaimer, the term of this patent is extended or adjusted under 35 U.S.C. 154(b) by 0 days.

(21) Appl. No.: 16/643,202

(22) PCT Filed: Dec. 5, 2017

(86) PCT No.: PCT/UA2017/000117
§ 371 (c)(1),
(2) Date: Feb. 28, 2020

(87) PCT Pub. No.: WO2019/074466
PCT Pub. Date: Apr. 18, 2019

(65) Prior Publication Data

US 2020/0206600 A1 Jul. 2, 2020

(30) Foreign Application Priority Data

Oct. 9, 2017 (UA) ..... u 2017 09775

(51) Int. Cl.
*A63C 17/02* (2006.01)
*A63C 17/00* (2006.01)

(52) U.S. Cl.
CPC ..... *A63C 17/02* (2013.01); *A63C 17/006* (2013.01); *A63C 17/008* (2013.01);
(Continued)

(58) Field of Classification Search
CPC ... A63C 17/02; A63C 17/006; A63C 17/0073; A63C 17/0066; A63C 17/008; A63C 17/0093
See application file for complete search history.

(56) References Cited

U.S. PATENT DOCUMENTS 275,482 A * 4/1883 Gregg ..... A63C 17/02 280/11.19
280,236 A * 6/1883 Phillips ..... A63C 17/02 280/11.19

(Continued)

FOREIGN PATENT DOCUMENTS

| | | | |
|---|---|---|---|
| CN | 103738443 | A | 4/2014 |
| SU | 1768197 | A1 | 10/1989 |
| WO | 199315799 | A1 | 8/1993 |

OTHER PUBLICATIONS

U.S. Pat. No. 280,236 of E.C. Phillips Issued Jun. 26, 1883, entitled "Roller Skate".

*Primary Examiner* — James A Shriver, II
*Assistant Examiner* — Michael T. Walsh
(74) *Attorney, Agent, or Firm* — DeLio Peterson & Curcio LLC; Thomas E. Ciesco

(57) ABSTRACT

The present invention relates to sports equipment, namely, to roller skates design enabling an athlete to achieve high speed of movement with better comfort and improved motion control, in particular, in case of movement on a lower quality road surfaces. Roller skates consist of two skates—right and left ones, each comprising a spatial rectangular frame with its upper surface adapted to be attached to a frame of the corresponding shoe, either left or right one, and its lower side having two pairs of rollers pivotally attached thereto such that the rollers may rotate being in contact with the roadway and the rollers' axes are parallel to the frame plane, and according to the invention each pair of front and rear rollers of each skate is pivotally attached to the corresponding Z-shaped wheel arm, either front or rear one, which has its central section pivotally attached to the corresponding smaller side of the spatial rectangular frame, and the distance between the axes of the inner rollers of a skate is greater than the distance between the axes of the external (Continued)

rollers. The present invention is aimed to provide such roller skates, which would be more reliable and safe due to increased stability of the skates during movement, also in case of lower quality road surface and during cornering. This objective is achieved by way of creating conditions for uniform distribution of the load arising from the weight of the athlete during movement among all four rollers of each skate, even when moving on a lower quality road surface.

5 Claims, 5 Drawing Sheets

(52) U.S. Cl.
CPC ..... *A63C 17/0066* (2013.01); *A63C 17/0073* (2013.01); *A63C 17/0093* (2013.01)

(56) References Cited

U.S. PATENT DOCUMENTS 1,597,213 A * 8/1926 Staples ..... A63C 17/02 280/11.26
1,606,902 A * 11/1926 Shoemaker ..... A63C 17/22 280/11.26
2,000,396 A * 5/1935 Keller ..... A63C 17/04 280/11.26
3,046,032 A * 7/1962 Humphries ..... A63C 17/02 280/11.19
4,763,909 A * 8/1988 Bergeron ..... A63C 5/035 280/11.25
5,382,031 A * 1/1995 Marconato ..... A63C 17/0073 280/11.223
5,449,183 A 9/1995 Klamer
5,797,609 A * 8/1998 Fichepain ..... A43B 5/1633 280/11.19
6,863,283 B1 * 3/2005 Houston ..... A63C 17/0046 280/11.225
9,539,489 B2 * 1/2017 Burns ..... A63C 17/02
9,561,424 B1 * 2/2017 Abel ..... A63C 17/002
2002/0105153 A1 * 8/2002 Miller ..... A63C 17/04 280/11.231
2002/0135143 A1 * 9/2002 Deetz ..... A63C 17/226 280/11.223
2003/0222418 A1 * 12/2003 Anderson ..... A63C 1/306 280/11.222
2008/0185798 A1 * 8/2008 Abel ..... A63C 17/04 280/11.19
2010/0044981 A1 * 2/2010 Chen ..... A63C 17/015 280/11.19
2013/0009369 A1 * 1/2013 Abel ..... A63C 17/004 280/11.19

* cited by examiner

ROLLER SKATES

BACKGROUND OF THE INVENTION

1. Field of the Invention

The present invention relates to sports equipment, namely, to roller skates design enabling an athlete to achieve high speed of movement with better comfort and improved motion control, in particular, in case of movement on a lower quality road surfaces.

2. Description of Related Art

Roller skates of the prior art consist of two identical skates—right and left ones, each comprising a spatial rectangular frame with its upper surface adapted to be attached to a shoe its lower side having a row of identical rollers attached thereto and located along one line [see e.g. international application PCT/EP2008/003659 (Jul. 5, 2008), international publication of the PCT application: WO 2008/135281 (Nov. 13, 2008)].

Such skates are widespread among professional athletes as they allow to attain a high speed of movement and reduce the radius of cornering due to increased roller diameters. To reduce the cornering radius, special devices are used in such skates, such to adjust a roller to slalom movement, and/or rollers of various diameters are installed. These design solutions significantly reduce the longitudinal stability of the athlete on the roller skates and affect comfort of movement. In addition, the use of such roller skates causes uneven wear of the rollers and bearings, therefore the movement parameters change over time, which affects the safety of the athlete.

Based on a number of essential features, the closest analog of the proposed roller skates are roller skates that consist of two skates—right and left ones, each comprising a spatial rectangular frame with its upper surface adapted to be attached to a frame of the corresponding shoe, either left or right one, and its lower side having two pairs of rollers pivotally attached thereto such that the rollers may rotate during movement and the rollers' axes are parallel to the frame plane [U.S. Pat. No. 280,236 A, cooperative A63C17/02, Patented: Jun. 26, 1883].

In skates according to U.S. Pat. No. 280,236, the shortcomings of the above-mentioned single-row skates are practically eliminated due to use of a two-row roller design and supplementing it with hinges with a central torsion. However, this solution is technically difficult to implement, and therefore not reliable enough. Thus, the hinges of the front and rear pairs of rollers are not able to provide simultaneous uniform distribution of the load among all four rollers due to the displacement of the gravity center relative to the area where rollers contact the roadway during the passage over even minor unevenness of the roadway, as well as during acceleration and cornering. Such skates do not allow to use rollers of different diameters, as this results in twisting of the torsions.

Therefore, the present invention is aimed to provide such roller skates, which would be more reliable and safe due to increased stability of the skates during movement, also in case of lower quality road surface and during cornering. This objective is achieved by way of creating conditions to ensure uniform and simultaneous distribution of the load among all four rollers of each skate during movement.

SUMMARY OF THE INVENTION

Similar to the roller skates of the prior art, roller skates according to the invention consist of two skates—right and left ones, each comprising a spatial rectangular frame with its upper surface adapted to be attached to a frame of the corresponding shoe, either left or right one, and its lower side having two pairs of rollers kinematically attached thereto such that the rollers may rotate being in contact with the roadway and the rollers' axes are parallel to the frame plane, while, according to the invention, each pair of front and rear rollers of each skate is pivotally attached to the corresponding Z-shaped wheel arm, either front or rear one, which has its central section pivotally attached to the corresponding smaller side of the spatial rectangular frame, and the distance between the axes of the inner rollers of a skate is greater than the distance between the axes of the external rollers.

A feature of the proposed roller skates is that each Z-shaped wheel arm is pivotally attached to its corresponding smaller side of the spatial rectangular frame by means of an elastic plastic sliding bearing.

Another feature of the proposed roller skates is that the spatial rectangular frame is provided with four spacing collars having limiters mounted thereon, one per each roller, said limiters being installed with the possibility to limit inclination of the frame during movement, for example, when cornering.

Further feature of the proposed roller skates is that the maximum distance $L_1$ between the axes of the inner rollers of each skate and the maximum distance $L_2$ between the axes of external rollers are defined by the following equation: $L_1=(1.2-1.5)\ L_2$.

Yet another feature of the proposed roller skates is that the spatial rectangular frame has a U-shaped cross-section, and its side parts are directed downwards. This form renders increased rigidity to the frame without increasing its weight.

Due to the increased stability, the roller skates according to the invention allow to use four large-diameter rollers (100 or more millimeters) still having a length of less than 380 millimeters (along the edges of the rollers). The design features of the proposed roller skates ensure uniform distribution of the load among all four rollers and the constant contact of all four rollers with the road even during the movement on a lower quality road surface, which enables the athlete to attain higher speed with high maneuverability and lower level of vibration during movement.

At the time of patent information research performed in the process of the present application preparation the authors have not revealed any roller skates design possessing the above mentioned set of essential features, which proves that the claimed technical solution complies with "novelty" patentability criterion.

The technical result obtained as the result of the present invention implementation is the possibility to create conditions for uniform distribution of the load arising from the weight of the athlete during movement among all four rollers of each skate, even when moving on a lower quality road surface.

The authors have not revealed the indicated technical result in the known technical solutions of the prior art, therefore the proposed roller skates may be deemed to comply with the "inventive step" patentability criterion.

The proposed roller skates consist of structural elements, which may be manufactured using presently known technological methods, means and materials. They may be used as sport or entertainment equipment or a ground vehicle, and thus pertain to different sectors of economy, therefore it is possible to conclude that the proposed solution complies with "industrial applicability" patentability criterion.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

The essence of the proposed invention is further explained by schematic drawings, where.

Figure 1:
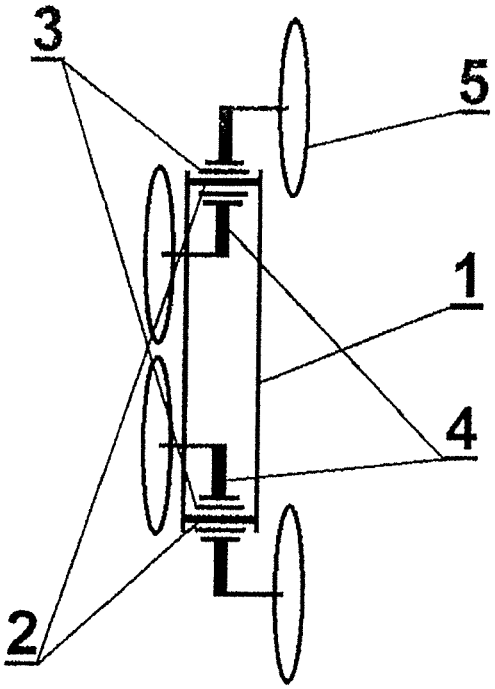
FIG. 1 shows a kinematic scheme of one of the proposed roller skates—the right one.
Figure 3:
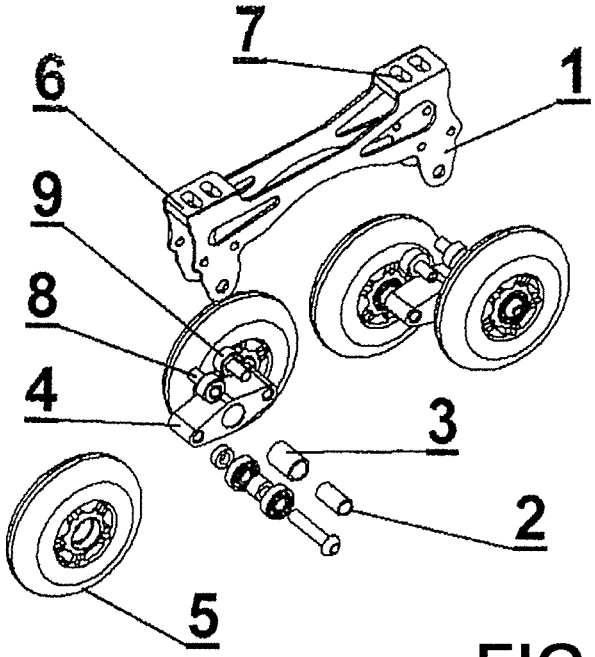
FIGS. 3, 4 show layout of the roller skates suspension.
Figure 4:
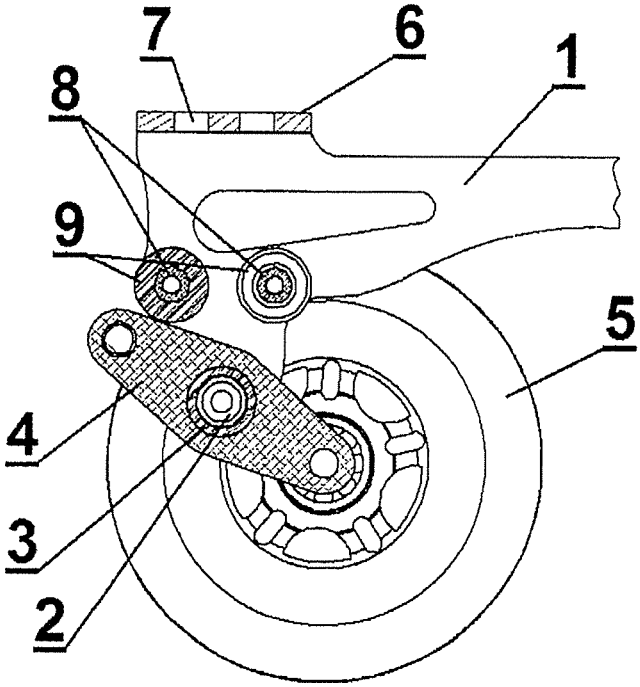

The proposed roller skates (FIGS. 1, 3, 4) include two skates, right and left ones, each consisting of a spatial rectangular frame 1 having U-shaped cross-section, two axes 2 with elastic plastic sliding bearings 3, two Z-shaped wheel arms 4 with four rollers 5 installed thereon. Axes of the rollers 5 of a skate are spaced apart and parallel to the plane of the frame 1. The spatial rectangular frame 1 has two supporting platforms 6 in its upper part with four mounting slots 7, i.e. two slots per each platform, to use the standard fastening of a skate to a shoe (not shown).

The spatial rectangular frame 1 is provided with four spacing collars 8 having limiters 9 mounted thereon, one per each roller 5, said limiters being installed with the possibility to limit inclination of the frame 1 during movement, in particular, when cornering.

Figure 2:
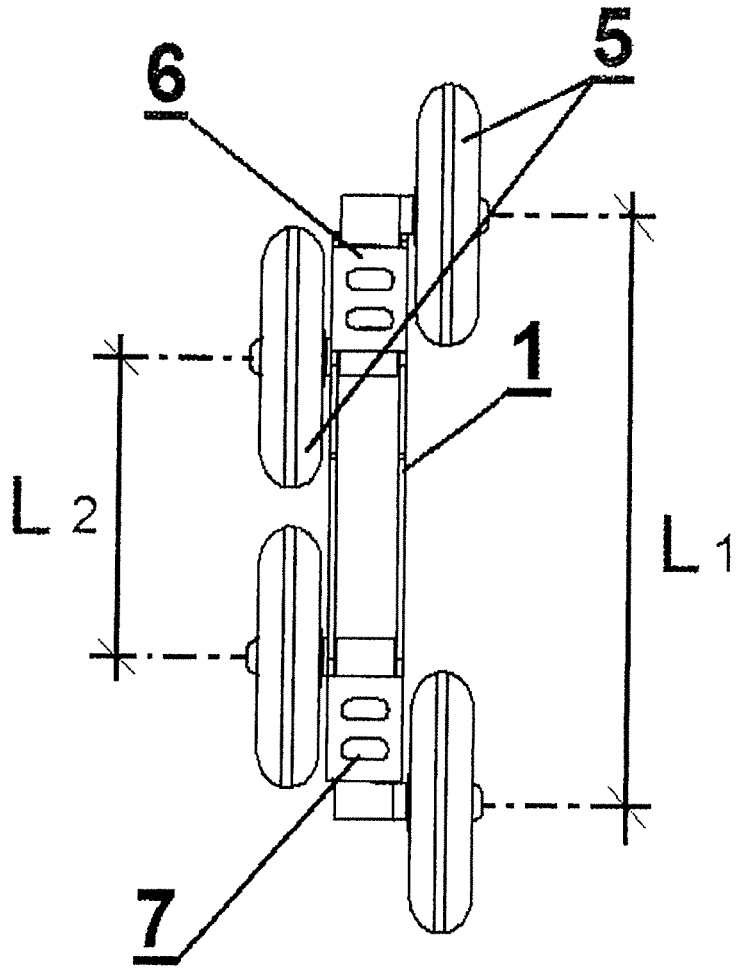
FIGS. 2, 6 show top view and the procedure for installing rollers of a skate.
Figure 5:
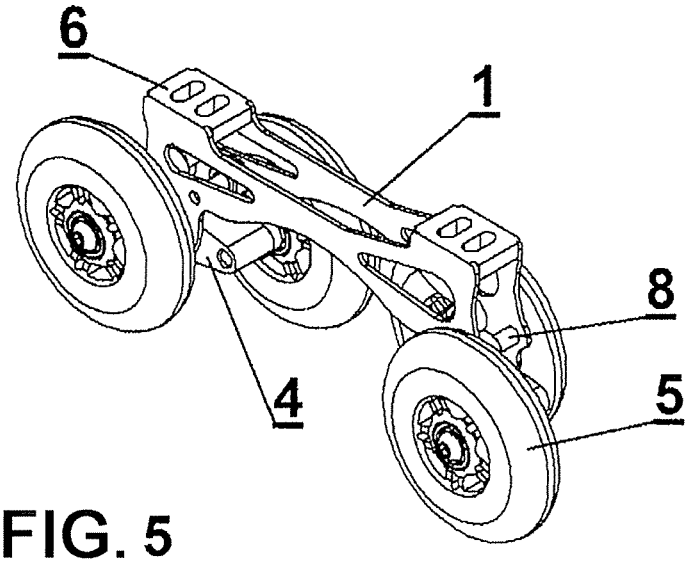
FIG. 5 shows a general view of the proposed roller skates.
Figure 6:
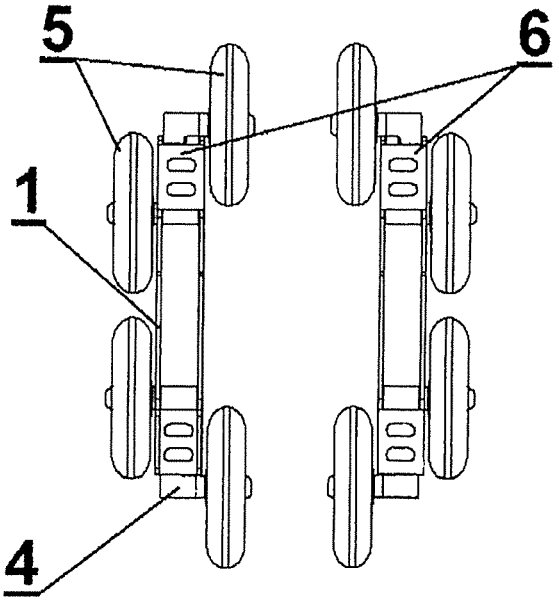

The rollers 5 are mounted on the ends of Z-shaped wheel arms 4 (FIGS. 2, 5, 6) in such a manner that the distance $L_1$ between the axes of the rollers 5 on the inside of a shoe (right and left, respectively) is maximum and the distance $L_2$ on the outer side is minimal. The authors have experimentally determined the optimal ratio of the mentioned distances, namely, the maximum distance $L_1$ between the axes of the inner rollers of each skate and the maximum distance $L_2$ between the axes of the outer rollers are defined by the equation: $L_1=(1.2-1.5)L_2$. Values beyond the limits of the above equation reduce the stability of an athlete on the skates and complicates the movement control.

The rollers 5 are mounted on the wheel arms 4 using standard fastening elements, i.e. bolts, bearings and spacing collars (FIG. 3) (shown schematically).

Spatial rectangular frame 1, Z-shaped wheel arms 4 and spacing collars 8 are made of extruded aluminum alloy. Elastic sliding bearings 3 and limiter 9 are made of polyurethane.

The proposed roller skates operate in the following manner.

Each pair of rollers 5 is mounted on the wheel arm 4 to the right and to the left of the longitudinal axis of the spatial frame 1, and each wheel arm 4 rotates freely on the axis 2 with elastic plastic sliding bearing 3.

This design allows even distribution of the load, with variable magnitude and direction arising, from athlete movements, from the spatial frame 1 to all four rollers 5 simultaneously.

Figure 7:
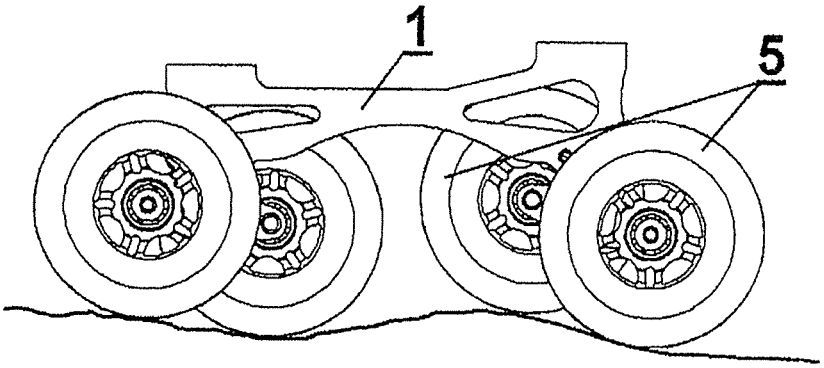
FIG. 7 is an example of the movement of roller skates while overcoming uneven area of a road surface.

Meanwhile, elastic plastic sliding bearings 3 absorb small shocks that occurring when passing over uneven area of the road surface (FIG. 7). At maximum turn of the Z-shaped wheel arm 4, limiters 9 made of elastic plastic prevent metal to metal hitting.

Figure 8:
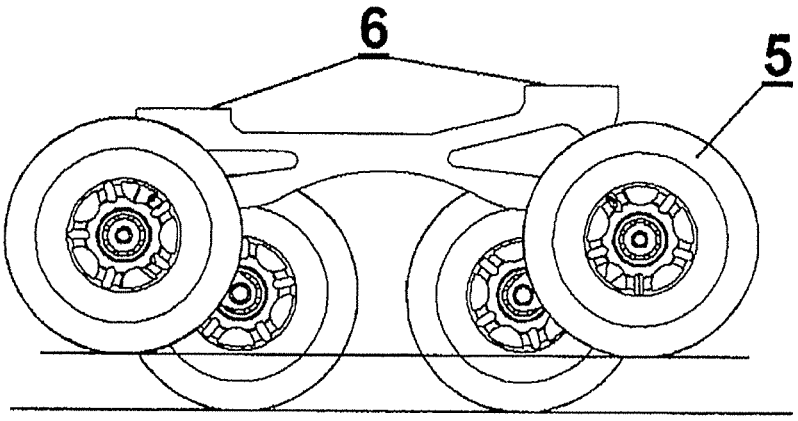
FIGS. 8, 9 show an example of the movement of roller skates while tilting to the left.
Figure 9:
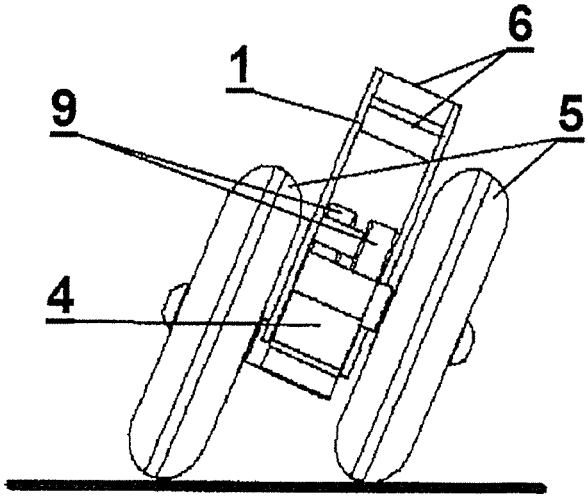

The position of the rollers 5 when moving with a side tilt during cornering is shown in FIGS. 8, 9. The movement is accompanied by a natural uniform wear of all four rollers 5 of the proposed skate, which virtually eliminates the loss of stability of the skates characteristic to the prototype device, and thus reduces operating costs.

The proposed design of roller skates allows the use of rollers 5 of different diameter +/−5.0 mm on one Z-shaped wheel arm 4 without compromising the properties of the skate.

The proposed roller skates have a lower cost compared to the prototype devise cost, a longer expected service life and provide more comfortable conditions for movement by increasing their stability both during movement and during the stop.

DESCRIPTION OF THE EMBODIMENT(S)

In describing the embodiment of the present invention, reference will be made herein to FIGS. 1-9 of the drawings in which like numerals refer to like features of the invention.

LIST OF ITEMS IN THE DRAWINGS

1—spatial rectangular frame;
2—axes;
3—elastic plastic sliding bearings;
4—Z-shaped wheel arms;
5—rollers;
6—supporting platforms;
7—mounting slots in supporting platforms;
8—spacing collars;
9—limiters.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. Roller skates consisting of two skates—right and left ones, each comprising a spatial rectangular frame with its upper surface adapted to be attached to a frame of the corresponding shoe, either left or right one, and its lower side having two pairs of rollers pivotally attached thereto such that the rollers may rotate being in contact with the roadway and the rollers' axes are parallel to the frame plane, wherein each pair of front and rear rollers of each skate is pivotally attached to the corresponding Z-shaped wheel arm, either front or rear one, which has its central section pivotally attached to the corresponding smaller side of the spatial rectangular frame, and the distance between the axes of the inner rollers of a skate is greater than the distance between the axes of the external rollers.

2. Roller skates according to claim 1, wherein each Z-shaped wheel arm is pivotally attached to its corresponding smaller side of the spatial rectangular frame by means of an elastic plastic sliding bearing.

3. Roller skates according to claim 1, wherein the spatial rectangular frame is provided with four spacing collars having limiters mounted thereon, one per each roller, said limiters being installed with the possibility to limit inclination of the frame during movement, for example, when cornering.

4. Roller skates according to claim 1, wherein the maximum distance L1 between the axes of the inner rollers of each skate and the maximum distance $L_2$ between the axes of external rollers are defined by the following equation: $L_1=(1.2–1.5)\ L_2$.

5. Roller skates according to claim 1, wherein the spatial rectangular frame of each skate has a U-shaped cross-section, and its side parts are directed downwards.

* * * * *